United States Patent [19]

Goldring

[11] Patent Number: 5,042,669

[45] Date of Patent: Aug. 27, 1991

[54] PRODUCT CARD DISPENSING RACK

[75] Inventor: Harold Goldring, Woodcliff Lake, N.J.

[73] Assignee: Goldring Display Group, Paramus, N.J.

[21] Appl. No.: 578,451

[22] Filed: Sep. 7, 1990

[51] Int. Cl.[5] ..... A47F 5/00

[52] U.S. Cl. ..... 211/4; 211/57.1; 211/59.1

[58] Field of Search ..... 211/59.1, 57.1, 4, 94.5; 206/806, 493

[56] References Cited

U.S. PATENT DOCUMENTS

| | | | |
|---|---|---|---|
| 1,149,691 | 8/1915 | Seamans | 211/59.1 |
| 3,850,300 | 11/1974 | Young | 211/4 |
| 4,026,415 | 5/1977 | Sarley | 211/4 |
| 4,072,246 | 2/1978 | Paulin | 211/59.1 X |
| 4,463,510 | 8/1984 | Windish | 211/59.1 X |
| 4,593,824 | 6/1986 | Pfeifer | 211/57.1 |
| 4,823,964 | 4/1989 | Lundberg | 211/59.1 X |
| 4,865,205 | 9/1989 | Thorneburg et al. | 211/59.1 |

*Primary Examiner*—Robert W. Gibson, Jr.
*Attorney, Agent, or Firm*—Anthony F. Cuoco

[57] ABSTRACT

A product card dispensing rack includes a plurality of product card dispensers which are flexurally secured at one end to the back of the rack. The front of the rack includes a door having a plurality of ledge members which normally cover the other end of the dispensers when the door is closed. Product cards disposed on the dispensers are removed from the rack by a purchaser or the like grasping a product card and exerting a downward force thereon, whereupon the other end of the dispenser is displaced away from the ledge member and exposed so that the card is displaced along the dispenser and removed therefrom at its other end. The door is opened for reloading the dispensers with product cards. The closed door may be locked for security purposes.

11 Claims, 2 Drawing Sheets

PRODUCT CARD DISPENSING RACK

BACKGROUND OF THE INVENTION

A variety of products, such as electronic appliance batteries, nuts, bolts, hooks and other such hardware products are packaged by encapsulating the products on cards whereby the familiar "blister" or "bubble" product cards are formed. Modern merchandising techniques require the cards to be supported for unattended dispensing, as for self-service merchandising.

A common way for unattended dispensing of these product cards is to provide product card dispensers or hooks which are supported on perforated (peg) boards, slat walls or other like mounting surfaces. A problem exists in that under these circumstances, the product cards can be easily removed from the hooks, either maliciously as by pilferers, or inadvertently as by passersby brushing against the hooks. The inventions disclosed in co-pending U.S. patent applications Ser. No. 522,852 filed on May 14, 1990 and U.S. patent application Ser. No. 539,928 filed on June 18, 1990 by Mark A Niven address this problem. These inventions feature particular types of dispensing hooks which are configured to require discrete manipulation for removing product cards therefrom.

The present invention further addresses the aforenoted problem in that it features a rack for supporting a plurality of product dispensing hooks. The rack has a door which, when closed and locked, is effective for impeding the aforenoted malicious or inadvertent removal of the product cards therefrom and, when unlocked and open, facilitates reloading product cards on the hooks, as is necessary from time to time.

SUMMARY OF THE INVENTION

This invention contemplates a product card dispensing rack including a pair of sides extending in vertical spaced relation and a plurality of supporting members mounted between the sides at the back thereof extending in horizontal spaced relation. A door is hinged to the front of one of the sides. The door includes a plurality of ledge members extending horizontally thereacross in corresponding spaced relation to that of the supporting members. The supporting members flexurally support a plurality of aligned product card dispensing hooks. When the door is closed, the dispensing hooks are covered by the ledge members to inhibit spurious removal of the product cards from said hooks. When the door is open, the hooks are exposed for enabling replacement of product cards as is necessary from time to time. The closed door may be locked for security purposes. With the door closed, a product card is grasped by a purchaser or the like and a downward force is exerted thereon, whereby the dispensing hook holding the card is flexed away from a corresponding ledge member so that the hook is exposed and the card can be removed from the rack. With the arrangement described, malicious and inadvertent removal of the cards from the hooks is impeded, as is desireable.

DETAILED DESCRIPTION OF THE INVENTION

Figure 1:
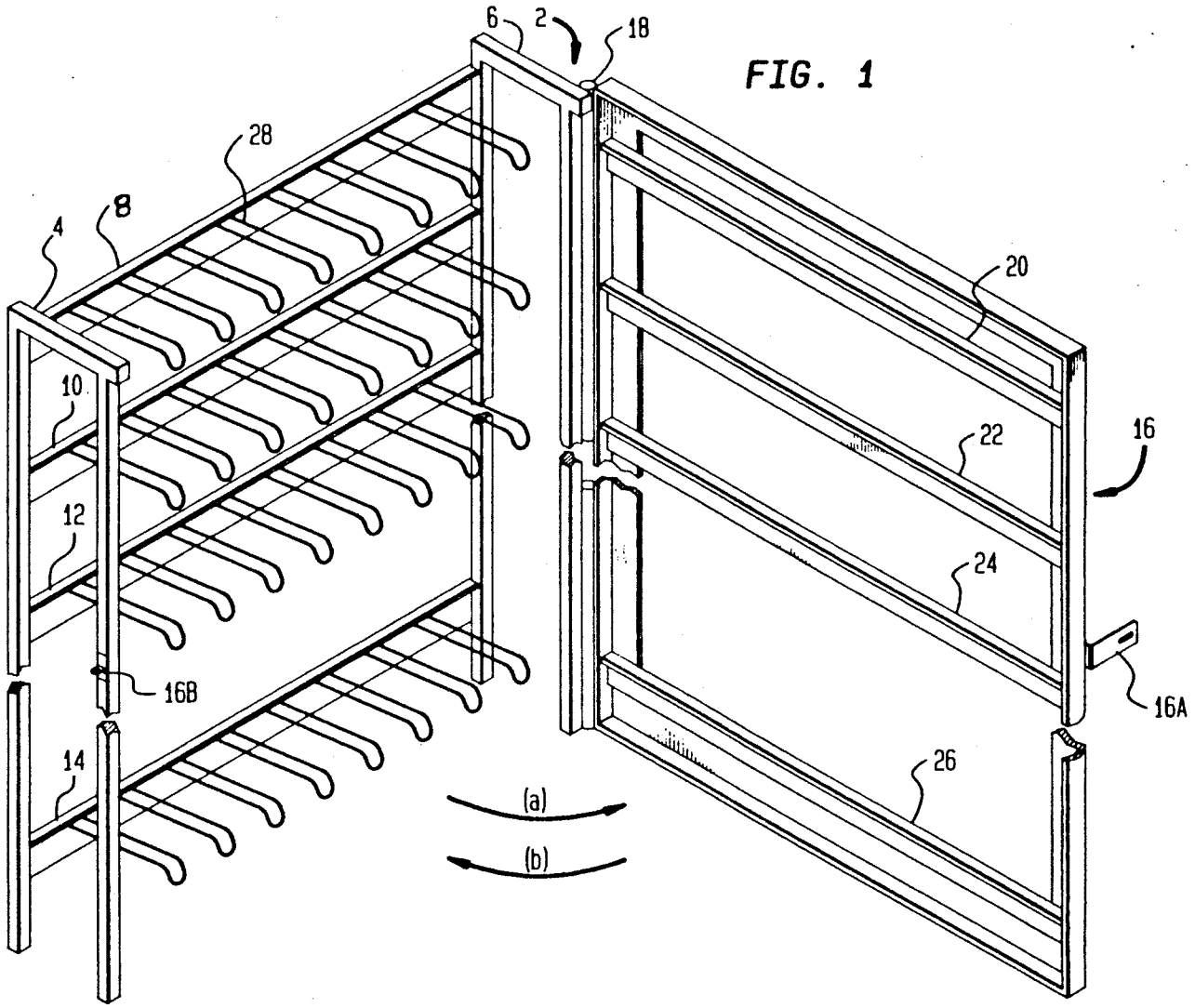
FIG. 1 is a fragmentary perspective view showing the product card dispensing rack of the invention with the door thereof open.

With reference to FIG. 1, a product card dispensing rack is designated generally by the numeral 2. Rack 2 has a pair of sides 4 and 6. Sides 4 and 6 extend in vertically spaced relation and support a plurality of dispensing hook supporting members shown for purposes of illustration as four in number and designated by the numerals 8, 10, 12 and 14. Supporting members 8, 10, 12 and 14 extend in horizontal spaced relation between sides 4 and 6.

Rack 2 includes a door 16 which is hinged to one of the sides, such as 2, by a hinge 18, whereby door 16 swings open in the direction of arrow (a) as shown in the Figure and swings closed in the direction of arrow (b).

Door 16 includes a plurality of horizontally disposed ledge members shown for purposes of illustration as four in number and designated by the numerals 20, 22, 24 and 26. Ledge members 20, 22, 24 and 26 extend horizontally across the door in corresponding spaced relation as that of supporting members 8, 10, 12 and 14 so that there is a corresponding ledge member for each supporting member.

Each of the supporting members 8, 10, 12 and 14 supports an aligned plurality of product card dispensing hooks designated by the numeral 28. Hooks 28 extend outward from and substantially normal to the supporting members. Product card dispensing hooks 28 are flexurally secured to their respective supporting members as by welding or the like at 32, as particularly shown in FIGS. 2 and 3, wherein supporting member 10 is shown for purposes of illustration. Likewise, ledge member 22 on door 16 is shown for purposes of illustration. The ledge members such as 22 have an inwardly extending ledge 22A, the purpose of which will be hereinafter described.

Figure 2:
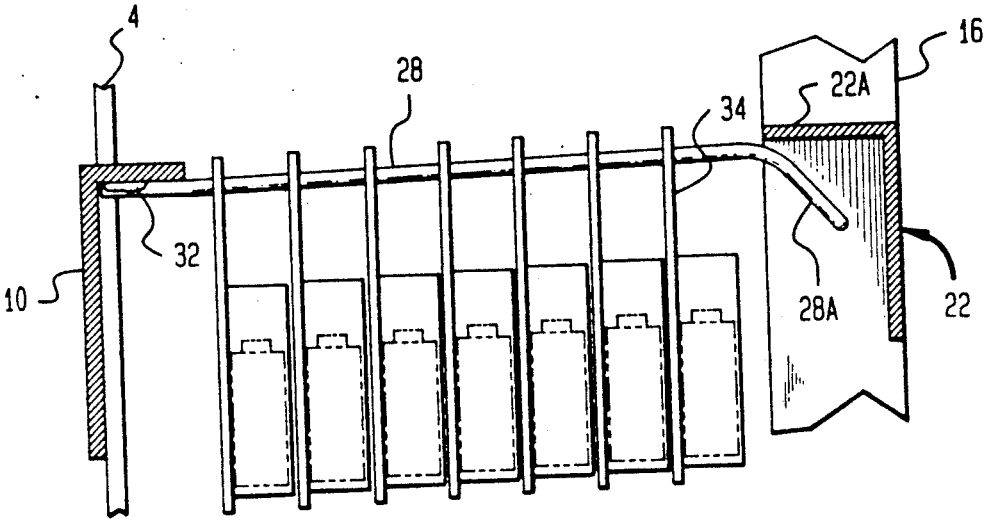
FIG. 2 is an enlarged fragmentary side view of the product card dispensing rack showing product cards on a product dispensing hook and the door of the rack closed.

With particular reference now to FIG. 2, product dispensing hook 28 has an end section 28A which extends angularly downward and beneath ledge 22A of ledge member 22 so as to be effectively covered thereby when door 16 is closed. Product dispensing hook 28 holds a plurality of product cards shown for purposes of illustration as seven in number and designated by the numeral 34. Under these circumstances, and with door 16 closed and locked to side member 4 as by conventional locking means 16A and 16B (FIG. 1), product cards 34 can be removed from hooks 28 only by overt manipulation of the cards. That is to say, in order to remove a product card as will be hereinafter explained, those intending to do same must linger at rack 2 for a period of time long enough to be a deterrent for malicious removal as by pilferers or the like than would otherwise be the case. The structure of the rack in and of itself impedes inadvertent removal as by brushing against a product dispensing hook than would also otherwise be the case.

Figure 3:
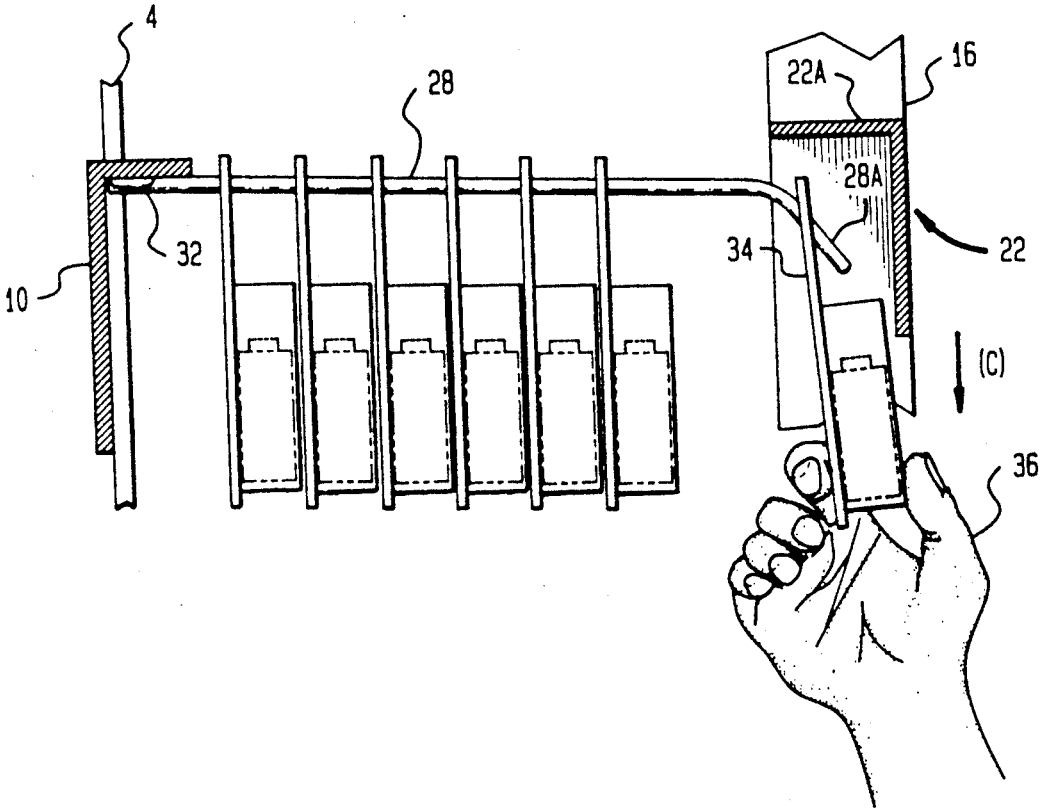
FIG. 3 is an enlarged fragmentary side view of the product card dispensing rack and illustrating the removal of a product card therefrom when the door is closed.

With particular reference now to FIGS. 1 and 3, in order to remove a product card 34 from a dispensing hook 28, the product card must be grasped by a purchaser or the like by a hand 36. A downward force, as indicated by arrow (c) in FIG. 3, is exerted by the purchaser via hand 36 on the product card, causing hook 28 to flex at 32 so that its end 28A is displaced away from ledge 22A, whereby hook end 28A is exposed. Product card 34 is dispensed by sliding it along hook 28 and off hook end 28A. When the aforenoted force is released, hook 28 flexes back so that its end 28A is again covered by ledge 22A to impede further product card removal.

When door 16 is unlocked and open, as shown in FIG. 1, product cards 34 can be easily disposed on dispensing hooks 28 whereby the dispensing hooks are refilled, as is required from time to time.

There has thus been described a product card dispensing rack which includes a plurality of aligned product dispensing hooks flexurally secured to the back of the rack. The front of the rack has a door which is closed and locked to prevent unauthorized product card removal. Product cards disposed on the dispensing hooks are removed from the rack when the door is closed and locked by first grasping a product card and then exerting a downward force on the card for flexing the dispensing hook to expose the otherwise covered end thereof, whereupon the product card is displaced along and off the hook. The overt manipulation thus required on the part of a purchaser or the like impedes spurious removal of the product cards from the rack, as is desireable. In the preferred embodiment of the invention, the product card dispensing rack herein disclosed may be of a suitable metal construction, with its several components secured to each other as by welding or the like, as will now be understood by those skilled in the art.

With the aforenoted description of the invention in mind, reference is made to the claims appended hereto for a definition of the scope of the invention.

What is claimed is:

1. A product card dispensing rack, comprising:

a pair of sides in vertical spaced relation, said sides extending from the back to the front of the rack;

means disposed at the back of the rack and supported by the sides, and extending therebetween;

a plurality of aligned product card dispensers flexurally supported by the means disposed at the back of the rack and extending therefrom to the front of the rack, each of which plurality of product card dispensers carries a plurality of product cards;

a door supported by one of the sides at the front of the rack for being closed to and opened away from the other of the sides, and including means aligned with the product card dispensers at the front of the rack so as to cover portions of the dispensers thereat when the door is closed, whereby dispensing of the product cards from the dispensers is inhibited;

a user grasping a product card and exerting a downward force thereon so that the dispenser carrying the grasped product card is flexed to expose the covered portion thereof; and the grasped product card being dispensed by displacing said card along the dispenser and off the exposed portion thereof.

2. A product card dispensing rack as described by claim 1, wherein the means disposed at the back of the rack and supported by the sides, and extending therebetween includes:

a plurality of horizontally disposed supporting members extending in spaced relation along the length of the back.

3. A product card dispensing rack as described by claim 2, wherein:

the plurality of product card dispensers are flexurally supported by the plurality of horizontally disposed supporting members and extend substantially normal therefrom to the front of the rack.

4. A product card dispensing rack as described by claim 3, wherein the means included on the door and aligned with the product card dispensers at the front of the rack so as to cover portions of the dispensers thereat when the door is closed includes:

a plurality of horizontally disposed ledge members extending in spaced relation along the length of the door corresponding to the spaced relation of the plurality of supporting members.

5. A product card dispensing rack as described by claim 4, wherein:

the dispenser is flexed so that the exposed portion of the dispenser carrying the grasped card is beneath the ledge member otherwise covering said exposed portion, whereupon the grasped product card is dispensed by displacing said card along the dispenser and off the exposed portion thereof.

6. A product card dispensing rack as described by claim 1, including:

locking means for locking the door to the other of the sides when said door is closed to said other side.

7. A product card dispensing rack as described by claim 1, wherein:

the product card dispensers are exposed when the door is opened away from the other of the sides, whereby product cards can be disposed on said dispensers.

8. A product card dispensing rack, comprising:

a back and a front, said front being a door for opening and closing the rack;

the back including means for flexurally supporting a plurality of aligned product card dispensers so that said dispensers are substantially normal to the back of the rack and extend to the front thereof, each of said dispensers supporting a plurality of product cards, said flexurally supporting means including a plurality of horizontally disposed supporting members extending in spaced relation along the length of the back, and the plurality of product card dispensers being flexurally supported by the plurality of horizontally disposed supporting members;

the door including means aligned with the product card dispensers for covering portions thereof at the front of the rack when the door is closed, whereby displacing of the product cards from the dispensers is inhibited;

a user grasping a product card and exerting a downward force thereon so that the dispenser supporting the grasped product card is flexed away from the covering means to expose the covered portion of the dispenser; and the grasped product card being dispensed by displacing said card along the dispenser and off the exposed portion thereof.

9. A product card dispensing rack, comprising:

a back and a front being a door for opening and closing the rack;

a plurality of horizontally disposed supporting members extending in spaced relation along the length of the back;

the back including means for flexurally supporting a plurality of aligned product card dispensers so that said dispensers are substantially normal to the back of the rack and extend to the front thereof, each of said dispensers supporting a plurality of product cards;

the door including means aligned with the product card dispensers for covering portions thereof at the front of the rack when the door is closed, whereby displacing of the product cards from the dispensers is inhibited, said aligned means including a plurality of horizontally disposed ledge members extending in spaced relation along the length of the door corresponding to the spaced relation of the plurality of supporting members;

a user grasping a product card and exerting a downward force thereon so that the dispenser supporting the grasped product card is flexed away from the covering means to expose the covered portion of the dispenser; and the grasped product card being dispensed by displacing said card along the dispenser and off the exposed portion thereof.

10. A product card dispensing rack as described by claim 9, including:

locking means for locking the door to the rack.

11. A product card dispensing rack, comprising:

a back and a front, said front being a door which is opened for opening the rack and closed for closing the rack;

the back including means for flexurally supporting a plurality of aligned product card dispensers so that said dispensers are substantially normal to the back of the rack and extend to the front thereof, each of said dispensers supporting a plurality of product cards, the product card dispensers being exposed when the door is opened for opening the rack, whereby product cards can be disposed on said dispensers;

the door including means aligned with the product card dispensers for covering portions thereof at the front of the rack when the door is closed, whereby displacing of the product cards from the dispensers is inhibited;

a user grasping a product card and exerting a downward force thereon so that the dispenser supporting the grasped product card is flexed away from the covering means to expose the covered portion of the dispenser; and the grasped product card being dispensed by displacing said card along the dispenser and off and the exposed portion thereof.

* * * * *